US006397979B1

(12) United States Patent
Samulak et al.

(10) Patent No.: US 6,397,979 B1
(45) Date of Patent: Jun. 4, 2002

(54) TRUCK MOUNTED BRAKE SYSTEM WITH INTERCHANGEABLE LEVER RATIO AND REPLACEABLE BRAKE HEADS

(75) Inventors: Zdzislaw Samulak; Gene Timourou, both of Watertown, NY (US)

(73) Assignee: New York Air Brake Corporation, Watertown, NY (US)

( * ) Notice: Subject to any disclaimer, the term of this patent is extended or adjusted under 35 U.S.C. 154(b) by 13 days.

(21) Appl. No.: 09/615,727

(22) Filed: Jul. 13, 2000

(51) Int. Cl.[7] ..... B61H 13/00
(52) U.S. Cl. ..... 188/52; 188/228.6
(58) Field of Search ..... 188/52, 53, 153 R, 188/219.1, 219.6, 228.6, 229.1, 231, 233.3, 233.7

(56) References Cited

U.S. PATENT DOCUMENTS

| | | | | |
|---|---|---|---|---|
| 796,714 | A | | 8/1905 | Frost |
| 3,107,754 | A | | 10/1963 | Bachman |
| 3,177,984 | A | | 4/1965 | Taylor |
| 3,298,474 | A | | 1/1967 | Roselius et al. |
| 3,378,108 | A | | 4/1968 | McClure et al. |
| 3,406,791 | A | | 10/1968 | Williams |
| 3,499,507 | A | | 3/1970 | Scott et al. |
| 3,731,766 | A | | 5/1973 | Campbell |
| 4,128,148 | A | | 12/1978 | Schmitt |
| 4,613,016 | A | | 9/1986 | Hart et al. |
| 4,771,868 | A | | 9/1988 | Haydu |
| 4,793,446 | A | | 12/1988 | Hart et al. |
| 5,069,312 | A | | 12/1991 | Kanjo et al. |
| 5,259,485 | A | | 11/1993 | Jackson |
| 5,400,874 | A | | 3/1995 | Gayfer et al. |
| 5,495,921 | A | | 3/1996 | Samulak et al. |
| 5,667,040 | A | | 9/1997 | Samulak et al. |
| 5,806,634 | A | | 9/1998 | Engle |
| 5,947,236 | A | | 9/1999 | Sauter |
| 6,079,795 | A | * | 6/2000 | Engle ..... 303/22.2 |
| 6,241,057 | B1 | * | 6/2001 | Hiatt ..... 188/219.1 |

* cited by examiner

*Primary Examiner*—Christopher P. Schwartz
(74) *Attorney, Agent, or Firm*—Barnes & Thornburg

(57) ABSTRACT

A method of adjusting the lever ratio of the brake system by adjusting the pivot points of the lever to the beam and the actuator elements to the lever. The brake beams each include a pair of spaced beam members connected by weldments which may include actuator mounts, hand brake fulcrum plates and brake heads. The brake head is welded to a back plate welded to the beam member and may be removed from the back plate by cutting the weld therebetween.

16 Claims, 4 Drawing Sheets b
b
22
34
24
30
32
26 d
c
32
26 d
b
32
26 d
b
26
32

TRUCK MOUNTED BRAKE SYSTEM WITH INTERCHANGEABLE LEVER RATIO AND REPLACEABLE BRAKE HEADS

BACKGROUND AND SUMMARY OF THE INVENTION

The present invention relates to brake apparatus rail cars and more specifically to a truck mounted brake apparatus.

Truck mounted brakes throughout the rail industry either include a double actuator system or a single actuator system. In all three of these systems, the actuator rod extends through holes in the bolster of the truck. The primary and secondary beams are usually cast iron beams. Also, the brake heads are either permanently attached or removable.

In an effort to reduce the cost, size and weight of the truck mounted brake, brake beams have been made out of channel material as illustrated in U.S. Pat. No. 5,947,236 to Sauter, owned by the Assignee of the present invention. The brake head is removably attached to the beam. The actuator is connected to one of the beams and through transfer levers and elements attached thereto apply with the brakes. The braking ratio usually fixed by the geometry of the levers and attachment. There is usually a minimum factor of 4 to 1 between the force produced by the actuator and applied by the brakes.

A system is needed to allow the changing or adjustment of the brake ratio in an easy and efficient way.

The present invention includes a method of adjusting the lever ratio of the brake system for a rail vehicle. This system includes first and second brake beams, an actuator connected to the first brake beam, a transfer lever pivotally connected to the second brake beam and first and second elements each having a second end connected to the opposite end of the transfer lever and a first end of the first and second elements are connected to the first beam actuator and the first beam respectively. The method includes providing a lever and first and second elements and selecting the position of the pivotal connection of the lever to the second beam and the distance between the pivotal connection of the lever to the second beam and the connection of the second end of the first and second elements to the lever to produce the desired lever ratio.

The connection of the first and second elements to the first beam is maintained constant and not adjusted. The position of the pivotal connection of the lever to the second beam and the distance between the pivotal connection of the lever to the second beam and the connection of the second ends of the first and second elements to the lever are selected also to maintain a preselected orientation of the first and second elements. The lever may include at least two apertures to define the pivotal connection of the lever to the beam. Also, the lever may have at least two apertures to define the connection of each element to the lever.

The brake system for the railroad vehicle may also include a first and second brake beam, each including a pair of vertically spaced beam members. The beam members are joined by first weldments. A pair of brackets are welded one to each of the beam members of the second brake beam and the lever is pivotally connected to the pair of brackets. The first weldment may include fulcrum plates welded to the pair of brake beam members. Hand brake lever is pivotally connected to the fulcrum plate. The first weldments may also include brake heads welded to the pair of brake beam members at each end of the beam members. The beam members each include a recess adjacent the end and the brake heads are in the recess. A second pair of brackets are welded one to each of the beam members of the first beam and the actuator is pivotally couple to the second pair of brackets.

A brake beam for a railroad vehicle includes at least a primary beam which includes, along a longitudinal axis, a center section and at each end an end section having a guide end extension to be received in slots of the side frames. A back plate is welded at each end section of the beam. A brake head is welded to each back plate. A brake shoe is removably mounted to each brake head. The brake beams include a pair vertically spaced beam members. The back plates are U-shaped with lips extending transverse to the legs of the U. The U extends into the space between the beam members. The U and the lips of the U are welded to the beam members. The brake head includes a guide extending from a back surface and received in the U of the brake head. The brake head is welded to the lips of the back pipe. The beam members each include a recess adjacent the end and the brake heads are in the recess.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
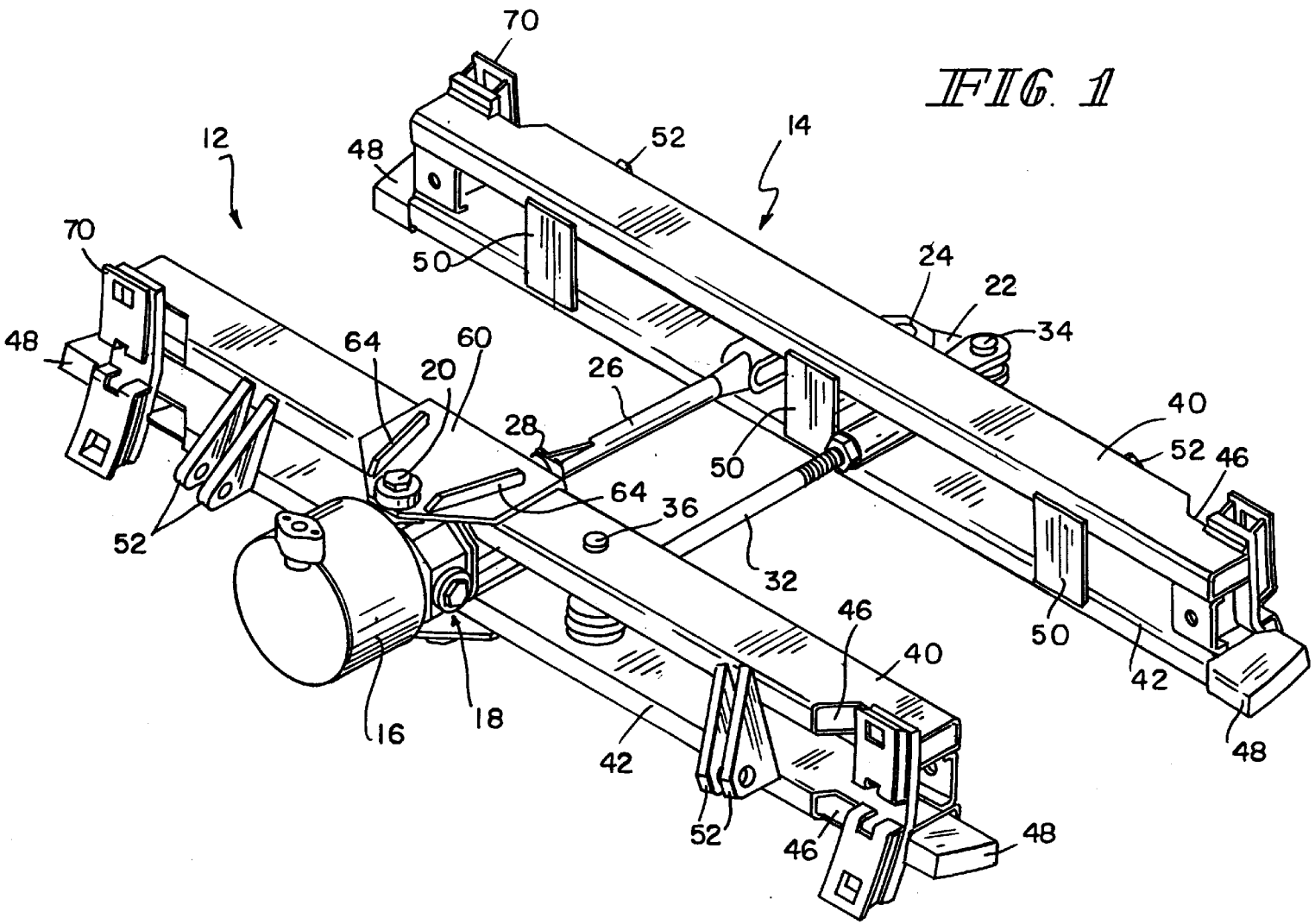
FIG. 1 is a first perspective view of a brake system according to the principles of the present invention without hand brake connection.
Figure 2:
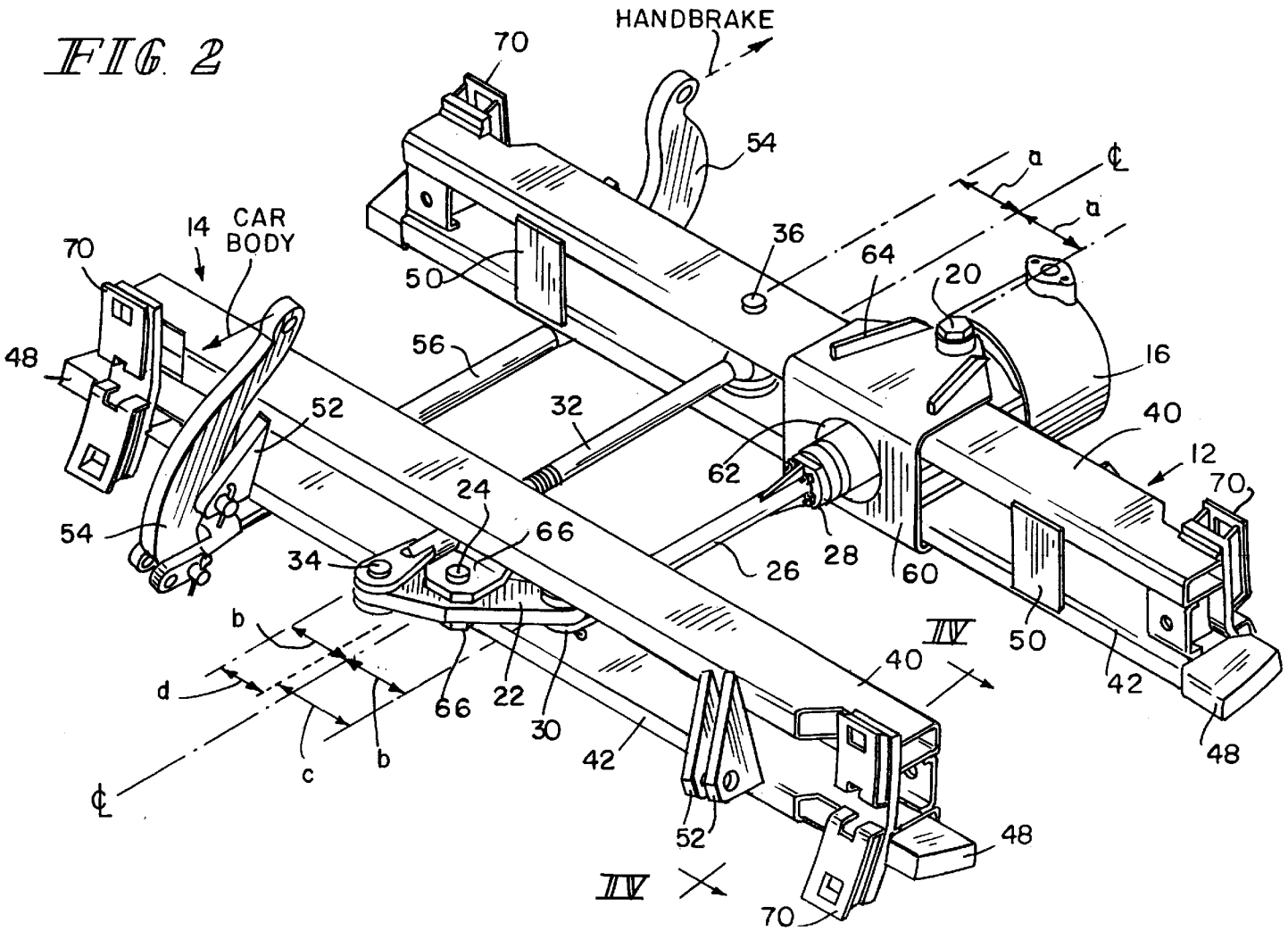
FIG. 2 is an opposite perspective view of a brake system according to the principles of the present invention including hand brake connection.

A brake system for rail vehicle 10 illustrated in FIGS. 1 and 2 includes a primary beam 12 and a secondary beam 14. An actuator 16 and gimbal 18 are pivotally mounted to the primary beam 12 by special screws 20. A transfer lever 22 is pivotally mounted at 24 to the secondary beam 14. A first element 26 is connected at first end 28 to the actuator 16 and the second end 30 to the transfer lever 22. A second element 32 is pivotally connected at its second end 34 to the transfer lever 22 and at its first end 36 to the primary beam 12. For the operation and more detail of the actuator system, reference should be made to U.S. Pat. No. 5,400,874 which is incorporated herein by reference.

Figure 3A:
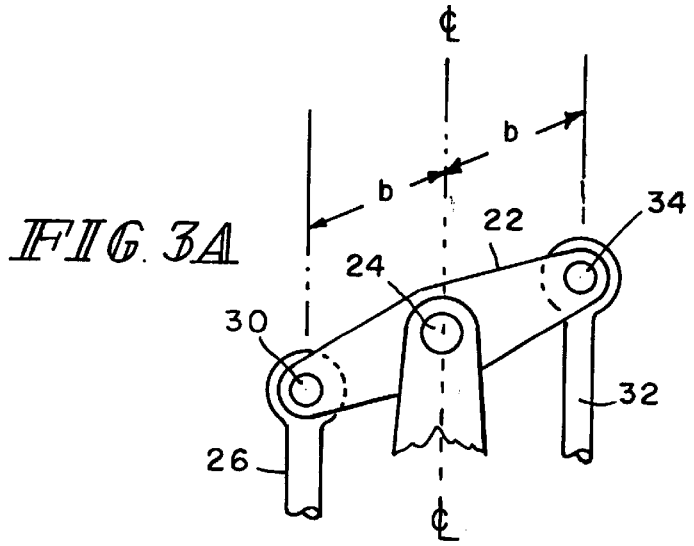
FIGS. 3A–3D illustrate the methods of adjusting the lever ratio of the brake system according to the principles of the present invention.

The standard arrangement as illustrated in FIGS. 2 and 3A, is that the distance "a" between the center line of the beam CL and the pivotal connection 20 of the actuator 16 and the connection 36 of the element 32 on the primary beam 12 are equal. The distance "b" between the pivotal connection 24 of the lever 22 and the pivotal connection 30 and 34 of the elements 26 and 32 respectfully are equal. This produces the standard lever ratio of 1:4. Thus, the force applied by the actuator 16 is multiplied by a factor of four to that applied to the brakes.

Figure 3B:
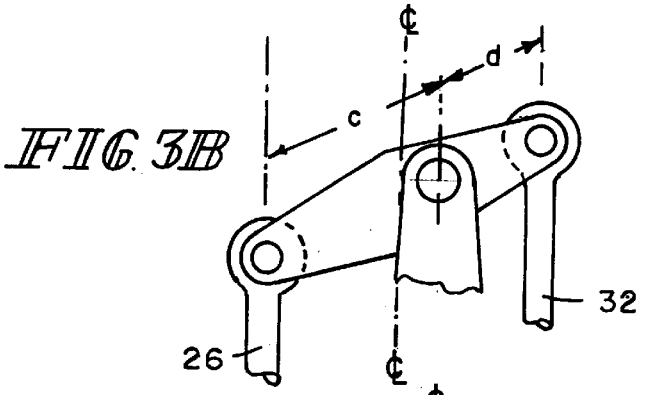

The method of adjusting the ratio in the present invention is by adjusting the relationship between the pivot point 24 of the lever 22 to the second beam 14 and its relationship to the connections 30 and 34 of the elements 26 and 32. To increase the lever ratio greater than 1:4, the pivot point 24 is moved closer to pivot point 34 and off the center line CL of the beams. This is illustrated in FIGS. 2 and 3B. The distance between the pivot point 30 of element 26 and the pivot point 24 of the lever 32 is a distance "c" and is greater than the distance "d" between the pivot point 24 of the lever 22 and the connection 34 of the element 32.

Figure 3C:
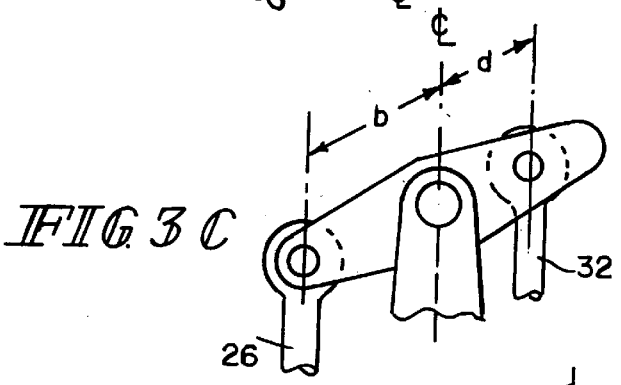

Alternatively, an increased ratio may also be produced by maintaining the pivotal connection 24 of the lever 22 on the center line CL such that the distance between the pivot point 24 of the lever 22 and the pivot point 30 of the element 26 is the same "b" and also moving the pivot point 34 of the element 32 closer to the pivot 24 of the lever 22 having a distance "d" as illustrated in FIG. 3C.

Figure 3D:
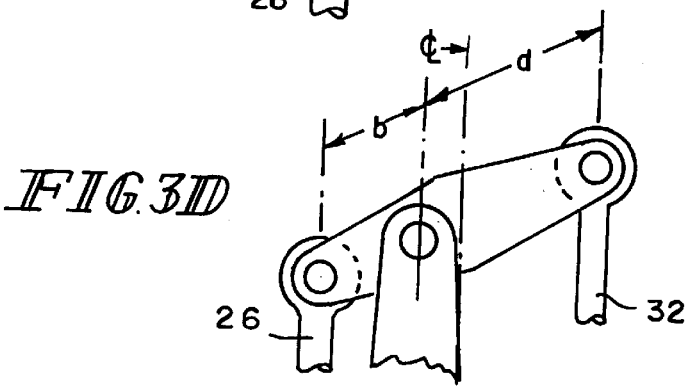

To decrease the ratio, the pivot point 24 of the lever 22 will be moved closer to the pivot point 30 of the element 26 and further from the pivot point 34 of the second element 32 as illustrated in FIG. 3D. This may also be achieved by either of the methods illustrated in FIGS. 3B and 3C.

One method of implementing the adjusted method is to use a standard lever 22 and set the apertures for each of the pivotal connections 24, 30 and 34. As a first alternative, a common lever 22 may be provided with multiple apertures for each of the pivot points 24, 30 an 34 such that the adjustment can be made in the field and only one common lever plate 22 would be manufactured. As a second alternative, the lever plate 22 can have its dimensions changed such that the pivot points 30 and 34 are always at the end of the lever and the opening for the pivot point 24 is selected to give the desired ratio.

The design of the lever 22 should be such that little if any variation in the length of the elements 26 and 32 are needed. This will reduce the number of additional special parts needed to implement the lever ratio adjustment. The locations of the pivots are also selected so as to maintain the preselected orientation of the first and second elements. Also, it should be noted that the position of the pivotal connection 20 of the actuator 16 and the connection 36 of the second element to first beam remain constant and are not adjusted.

Each of the brake beams 12 and 14 are formed from a pair of vertically spaced beam members 40 and 42. The beam members are shown as closed rectangular tubes which may be formed from tube stock. Alternatively, it may be formed from welding together a pair of channel elements, for example, C or L channel elements. Each of the beam members 40 and 42 include a recess 46 adjacent the end of the beam members. Guide plates 48 are welded to the lower beam member 42 at each end. The guide plates are received in slots in the side frames of the truck to mount the beams to the truck. The relationship of the brake system with respect to the wheels and bolster is illustrated in the aforementioned U.S. Pat. No. 5,947,236 which is incorporated herein by reference, as well as U.S. Pat. No. 5,400,874.

Connecting plates 50 are welded to each of the beam elements 40 and 42 on one side and form a first weldment. On the other side of the beams 40 and 42, fulcrum plates 52 are welded also as a first weldment. The fulcrum plates are to be used with a hand brake system illustrated in FIG. 2. A pair of levers 54 are pivotally mounted between a pair of fulcrum plates 52 and a connecting rod 56 is pivotally connected to each of the levers 54. One of the levers connect the car body and the other is connected to the hand brake.

A band plate 60 being U-shaped is welded to the beam elements 40 and 42 of the primary beam 12. It includes aperture 62 through which extends a portion of the actuator 16. The pivotal connection 20 of the actuator 16 and gimbal 18 is through an extended portion of the band plate 60. A pair of stiffners 64 are provided on the top and bottom legs of the band plate 60.

A pair of brackets 66 are welded to each of the beam members 40 and 42 of the secondary beam 14. A transfer lever 22 is provided between the bracket 66 and the pivotal connection 24 is made thereto. With the construction illustrated in FIGS. 1 and 2, the transfer lever 22 can rotate into and out of the space between the beam members 40 and 42. This reduces the amount of space needed between the sides or faces of the beams 40 and 42 and the adjacent car or truck structure.

Figure 4:
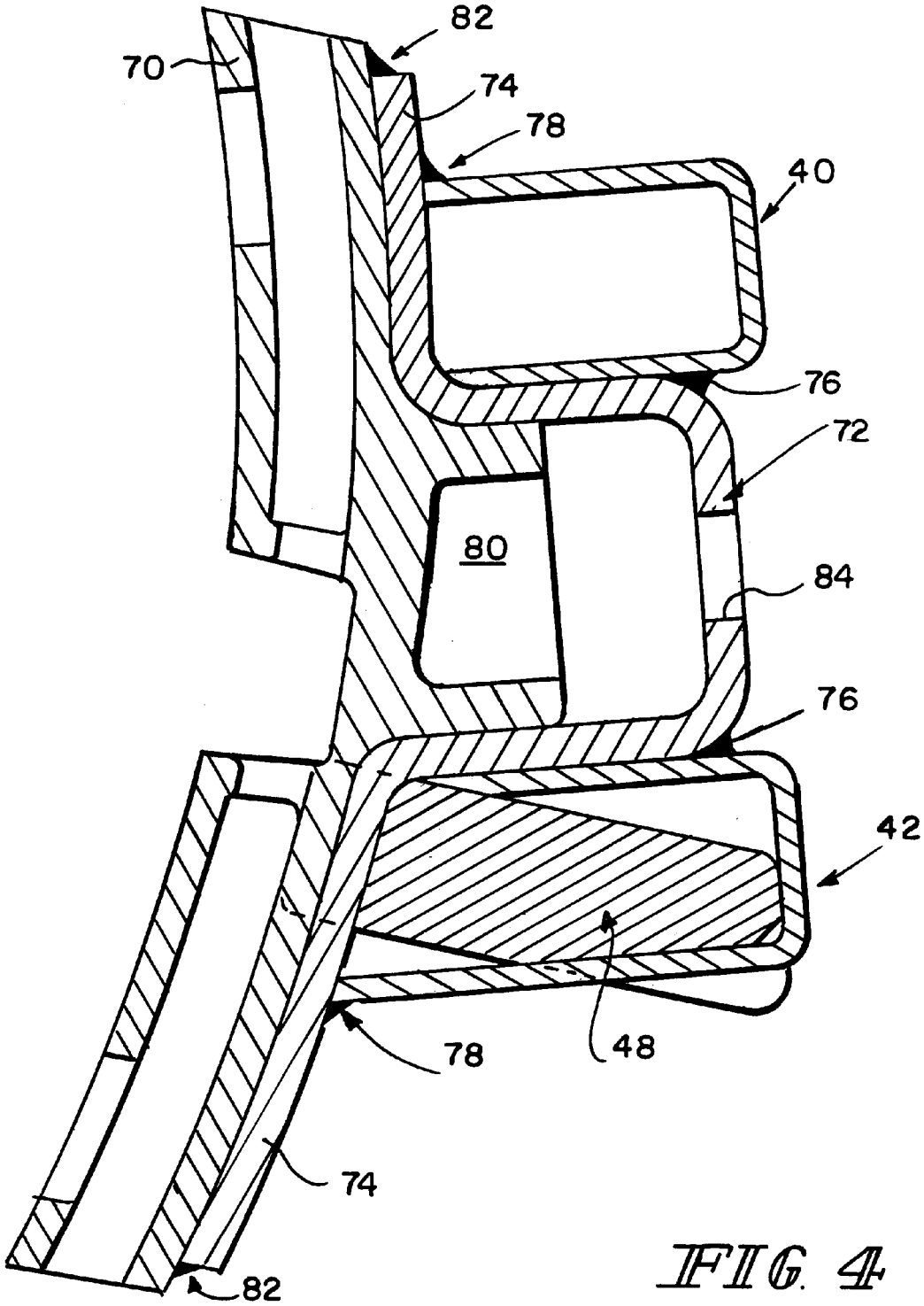
FIG. 4 is a cross sectional view along lines IV—IV of FIG. 2.

A removable brake head 70 is connected at each end of the primary and secondary beams 12 and 14 in the recess 46. As illustrated in detail in FIG. 4, the brake head system includes a U-shaped back plate 72 having lips 74 extending transverse from the legs of the U. The U part of the back plate 72 lies in the area between the beam elements 40 and 42 and is welded thereto at 76. The lips 74 are welded to the beam elements 40 and 42 at 78. The back plate 72 forms part of the weldments which interconnect the beam elements 40 and 42. The brake head 70 includes a guide 80 extending from the back surface and is received in the U of the back plate 72. The brake head 70 is welded to the back plate 70 at its lip 74 by welds 82. A brake shoe is mounted to the brake head 70 by a brake shoe key (neither of which are shown).

If the brake head 70 is worn during service, it is removed by cutting the top and bottom welds 82 to the back plate 72. The back plate 72 remains in place on the beams. To aid removal of the brake head 70, an opening 84 is provided in the base of the U. A steel bar can be inserted through opening 84 to push the brake head 70 out of and off the back plate 72. The brake head 70 is then positioned on and in the back plate 72 and new welds 82 are created attaching it to the lip 74 of the back plate 72. The beams can stay on the track during the repair or may be removed and repaired at a shop. By using the back plate 72, it forms part of the welding which stabilizes the beam elements 40 and 42 while allowing removal of the brake head 70 without affecting the integrity of the combined brake beams 12, 14.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A method of adjusting the lever ratio of brake system for a railway vehicle which includes first and second brake beams, an actuator connected to the first brake beam, a transfer lever pivotally connected to the second brake beam, first and second elements each having a second end connected to opposite arms of the transfer lever and a first end connected to the first brake actuator and the first brake beam respectively; the method comprising:

providing a lever having multiple pivot point connections for the first and second elements and for the pivotal connection of the lever to the second beam;

selecting the position of the pivotal connection of the lever to the second beam and the distance between the pivotal connection of the lever to the second beam and the connection of the second ends of the first and second elements to the lever to produce the desired lever ratio.

2. The method according to claim 1, wherein the connection of the first and second elements to the first beam is maintained constant.

3. The method according to claim 1, wherein the position of the pivotal connection of the lever to the second beam and the distance between the pivotal connection of the lever to the second beam and the connection of the second ends of the first and second elements to the lever are selected also to maintain a preselected orientation of the first and second elements.

4. The method according to claim 1, wherein the lever has at least two apertures defining the pivotal connection of the lever to the second beam.

5. The method according to claim 1, wherein the lever has at least two apertures defining the connection of each element to the lever.

6. A brake system for a railway vehicle which includes first and second brake beams, an actuator connected to the first beam, a transfer lever pivotally connected to the second brake beam, first and second elements each having a second end connected to opposite arms of the transfer lever, the first element having a first end connected to the actuator and the second element having a first end connected to the first brake beam; wherein:

the first and second brake beams each include a pair of vertically spaced beam members;

the beam members are joined by first weldments wherein the first weldments include fulcrum plates welded to the pair of beam members;

a hand brake lever pivotally connected to the fulcrum plates;

a pair of brackets are welded one to each of the beam members of the second brake beam; and the transfer lever is pivotally connected to the pair of brackets.

7. The brake system according to claim 6, wherein the first weldments include brake heads welded to the pair of beam members at each end of the beam members.

8. The brake system according to claim 7, wherein the beam members each include a recess adjacent the end and the brake heads are in the recess.

9. The brake system according to claim 6, including a band plate welded to each of the beam members of the first brake beam; and the actuator is pivotally connected to the transfer lever through the band plate.

10. A brake beam for a railway vehicle comprising:

at least a primary beam including, along an longitudinal axis, a center section and at each end an end section having a guide end extension to be received in slots in a truck;

a back plate welded at each end section of the beam;

a brake head welded to each back plate; and a brake shoe removably mounted to each brake head.

11. The brake beam according to claim 10 wherein the brake beam includes a pair of vertically spaced beam members; the back plates are U-shaped with lips extending transverse from the legs of the U; and the U extends into the space between the beam members.

12. The brake beam according to claim 11, wherein the U and the lips are welded to the beam members.

13. The brake beam according to claim 11, wherein the brake head includes a guide extending from a brake surface and received in the U of the back plate.

14. The brake system according to claim 11, wherein the brake head is welded to the lips.

15. The brake beam according to claim 10, wherein the brake beam includes a pair of vertically spaced rectangular tube beam members.

16. The brake beam according to claim 10, wherein the beam members each include a recess adjacent the end and the brake heads are in the recess.

* * * * *